US007175311B2

(12) United States Patent
Chen

(10) Patent No.: US 7,175,311 B2
(45) Date of Patent: Feb. 13, 2007

(54) TOP WITH A LIGHTING DEVICE

(76) Inventor: Yi Ta Chen, 5F, No. 12, Lane 55, Sec. 4, Minsheng E. Rd., Songshan District, Taipei City 105 (TW)

( * ) Notice: Subject to any disclaimer, the term of this patent is extended or adjusted under 35 U.S.C. 154(b) by 89 days.

(21) Appl. No.: 11/176,332

(22) Filed: Jul. 8, 2005

(65) Prior Publication Data

US 2007/0010162 A1 Jan. 11, 2007

(51) Int. Cl.
*F21V 33/00* (2006.01)
*A63H 1/24* (2006.01)

(52) U.S. Cl. ..... 362/253; 446/242

(58) Field of Classification Search ..... 362/253, 362/35, 800; 273/173; 446/236, 242, 256
See application file for complete search history.

(56) References Cited

U.S. PATENT DOCUMENTS 2,623,327 A * 12/1952 Testino ..... 446/242
3,191,344 A * 6/1965 Yagjian ..... 446/242
3,803,757 A * 4/1974 Sanchez ..... 446/242
6,083,076 A * 7/2000 Saint-Victor ..... 446/242
6,666,743 B2 * 12/2003 Polare et al. ..... 446/256
6,969,296 B1 * 11/2005 Chen ..... 446/242

* cited by examiner

*Primary Examiner*—Ali Alavi
(74) *Attorney, Agent, or Firm*—Rosenberg, Klein & Lee

(57) ABSTRACT

A top with a lighting device includes a hollow body and a cover detachably inserted into a top of the hollow body. The cover has a grip upward and centrally extending from a top of the cover and a through hole defined therein. A skirt centrally and downward extends from a bottom of the cover to define a cavity for receiving a battery. An L-shaped electrode plate is mounted to the skirt and electrically connected to a first electrode of the battery. The lighting device has a lighting element received in the through hole. The lighting element has a first electrode electrically connected to a second electrode of the battery and a second electrode selectively electrically connected to the L-shaped electrode plate for lighting the lighting element.

5 Claims, 7 Drawing Sheets

TOP WITH A LIGHTING DEVICE

BACKGROUND OF THE INVENTION

1. Field of the Invention

The present invention relates to a top, and more particularly to a top with a lighting device for promoting an amusing effect of the top.

2. Description of Related Art

A conventional top in accordance with the prior art only has a monotone type. Some top manufacturer changes the weight of the conventional top for an adult to train his/her arms or for a child to easily operating the top. For an amusing effect, some conventional tops provide whistle effect when being rotated.

However, all the conventional tops provide no lighting effect such that the conventional top needs to be advantageously altered The present invention has arisen to mitigate and/or obviate the disadvantages of the conventional top.

SUMMARY OF THE INVENTION

The main objective of the present invention is to provide an improved top that has a lighting device for promoting an amusing effect of the top.

To achieve the objective, the top in accordance with the present invention comprises a hollow body and a cover detachably inserted into a top of the hollow body. The cover has a grip upward and centrally extending from a top of the cover and a through hole defined therein. A skirt centrally and downward extends from a bottom of the cover to define a cavity for receiving a battery. An L-shaped electrode plate is mounted to the skirt and electrically connected to a first electrode of the battery. The lighting device has a lighting element received in the through hole. The lighting element has a first electrode electrically connected to a second electrode of the battery and a second electrode selectively electrically connected to the L-shaped electrode plate for lighting the lighting element.

Further benefits and advantages of the present invention will become apparent after a careful reading of the detailed description with appropriate reference to the accompanying drawings.

DETAILED DESCRIPTION OF THE INVENTION

Figure 1:
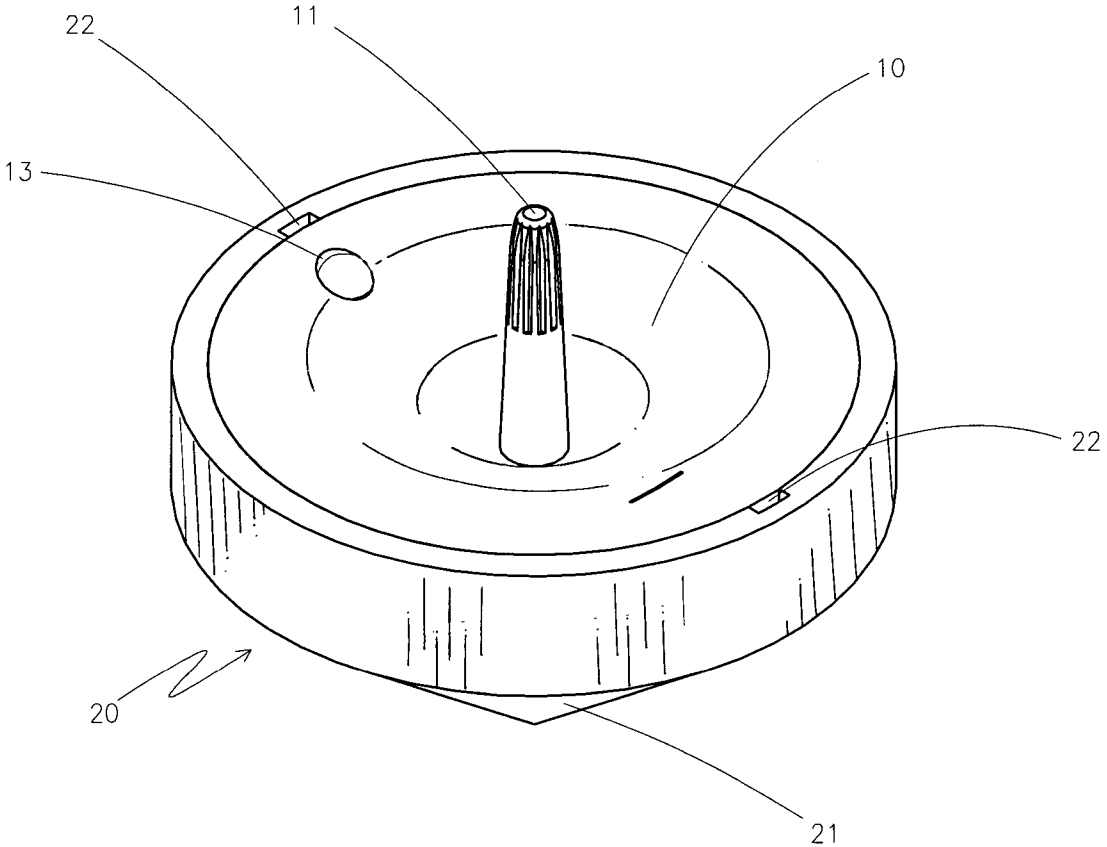
FIG. 1 is a perspective view of a top with a lighting device in accordance with the present invention.
Figure 2:
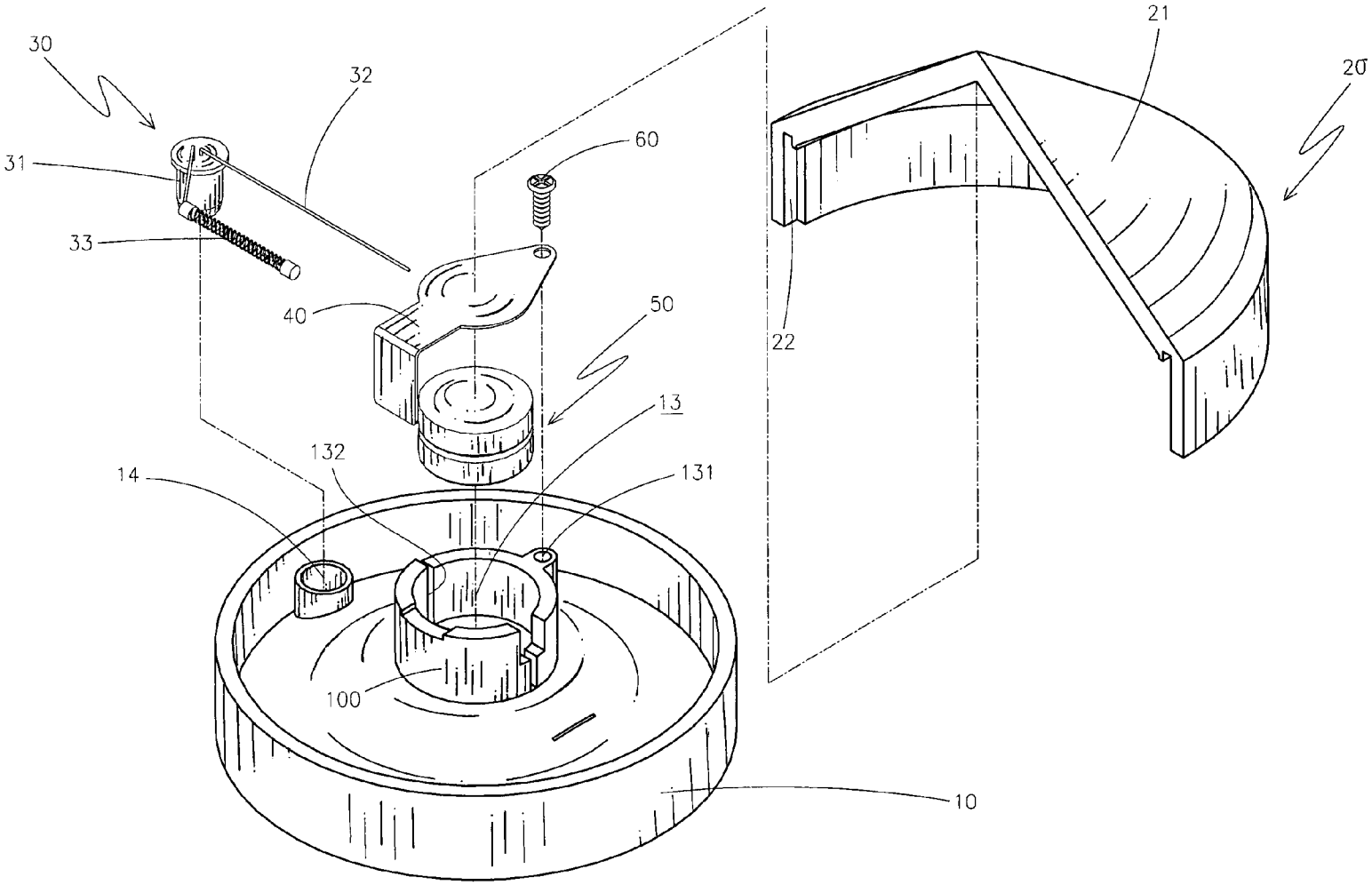
FIG. 2 is an inverted exploded perspective view of the top in FIG. 1.
Figure 3:
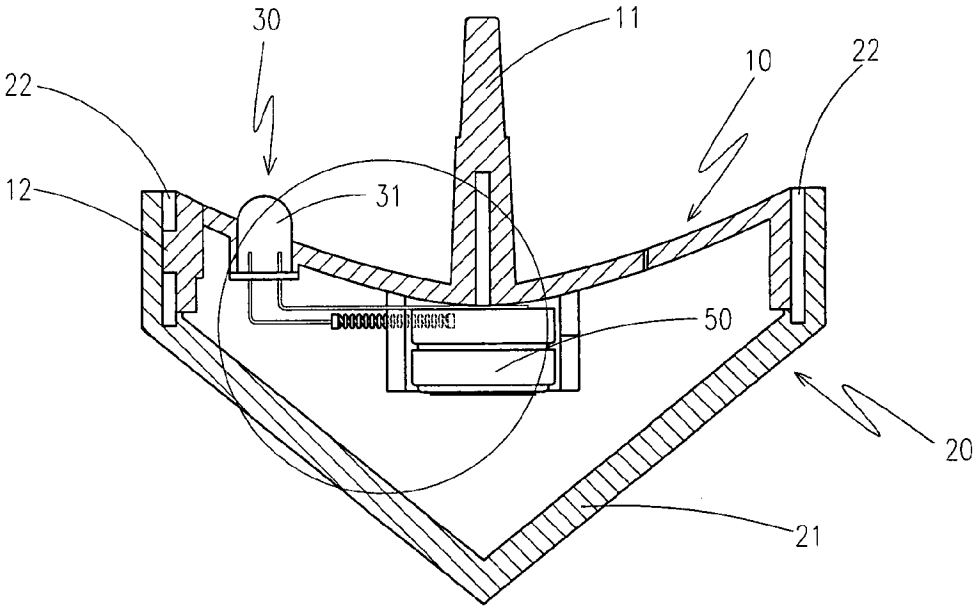
FIG. 3 is a cross-sectional view of the top in FIG. 1.
Figure 3A:
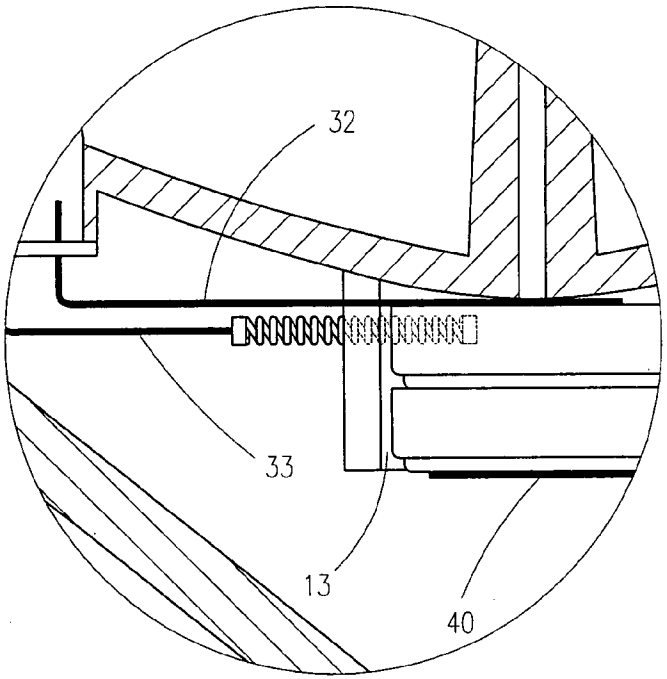
FIG. 3A is a partially enlarged view of FIG. 3.

Referring to the drawings and initially to FIGS. 1–3, a top with a lighting device (30) in accordance with the present invention comprises a hollow body (20) and a cover (10) detachably inserted into a top of the hollow body. The cover (10) has a grip (11) upward and centrally extending from a top of the cover (10) and a buckle (12) laterally extending from the cover (10) for engaging the cover (140) to the hollow body (20). A skirt (100) centrally and downward extends from a bottom of the cover (10) to define a cavity (13) for receiving a battery (50). A threaded hole (131) is longitudinally defined in the skirt (100) and a slot (132) is defined in the skirt (100). An L-shaped electrode plate (40) is mounted to the skirt (100) by a bolt (60) that extends through the L-shaped electrode plate (40) and is screwed into the threaded hole (131) to hold the L-shaped electrode plate in place. The L-shaped electrode plate (40) is electrically connected to a first electrode of the battery (50).

The lighting device (30) is mounted in the hollow body (20). The lighting device (30) includes a lighting element (31) received in a through hole (14) that is defined in the top of the cover (10). The lighting element (31) has a first electrode (32) extending through the slot (132) in the skirt (100) and electrically connected to a second electrode of the battery (50), and a second electrode (33) located between the skirt (100) and the L-shaped electrode plate (40). The second electrode is a spring.

Figure 4:
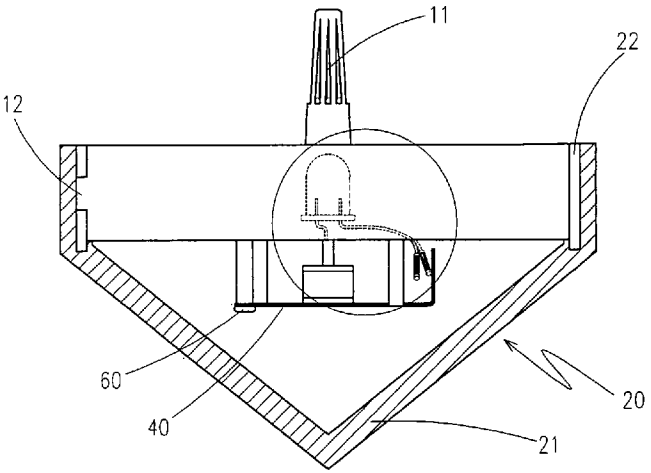
FIG. 4 is an operational view of the top in FIG. 1.
Figure 4A:
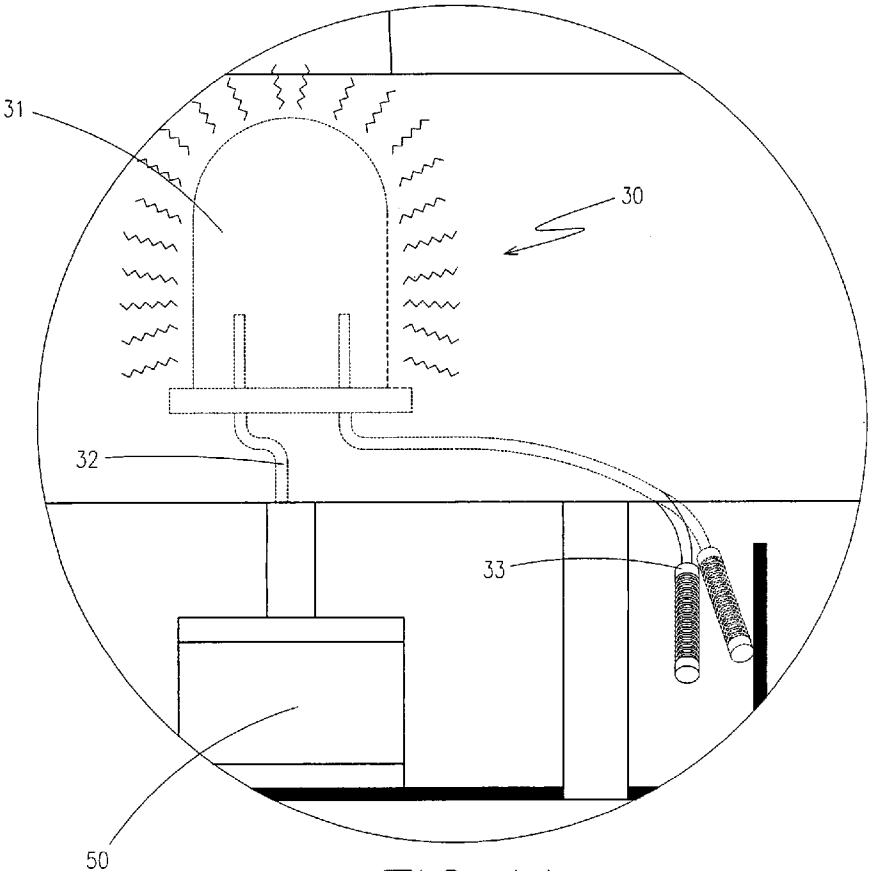
FIG. 4A is a partially enlarged view of FIG. 4.

With reference to FIG. 4, the second electrode (33) is separated relative to the L-shaped electrode plate (40) such that the lighting element (31) is in a condition of power failure. The second electrode (33) of the lighting element (31) is swung to contact with the L-shaped electrode plate (40) and form a closed circuit due to a centrifugal force from the rotating top. As a result, the lighting element (31) is lighted.

Figure 5:
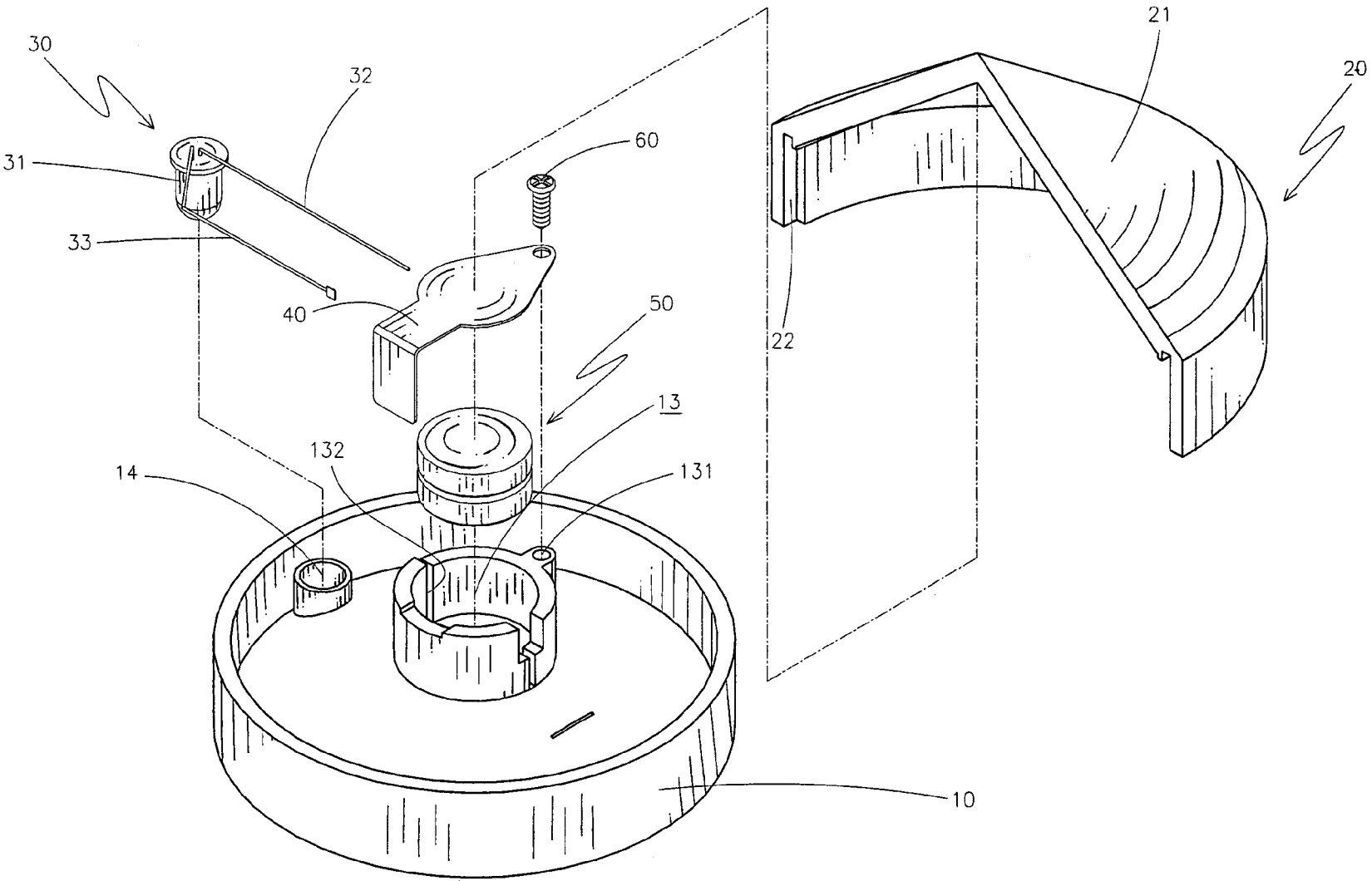
FIG. 5 is an exploded perspective view of a second embodiment of the top in accordance with the present invention.

With reference to FIG. 5 that shows a second embodiment of the top of the present invention, the second electrode (33) is altered to a plate for raising the contact area between the second electrode (33) and the L-shaped electrode plate (40).

Figure 6:
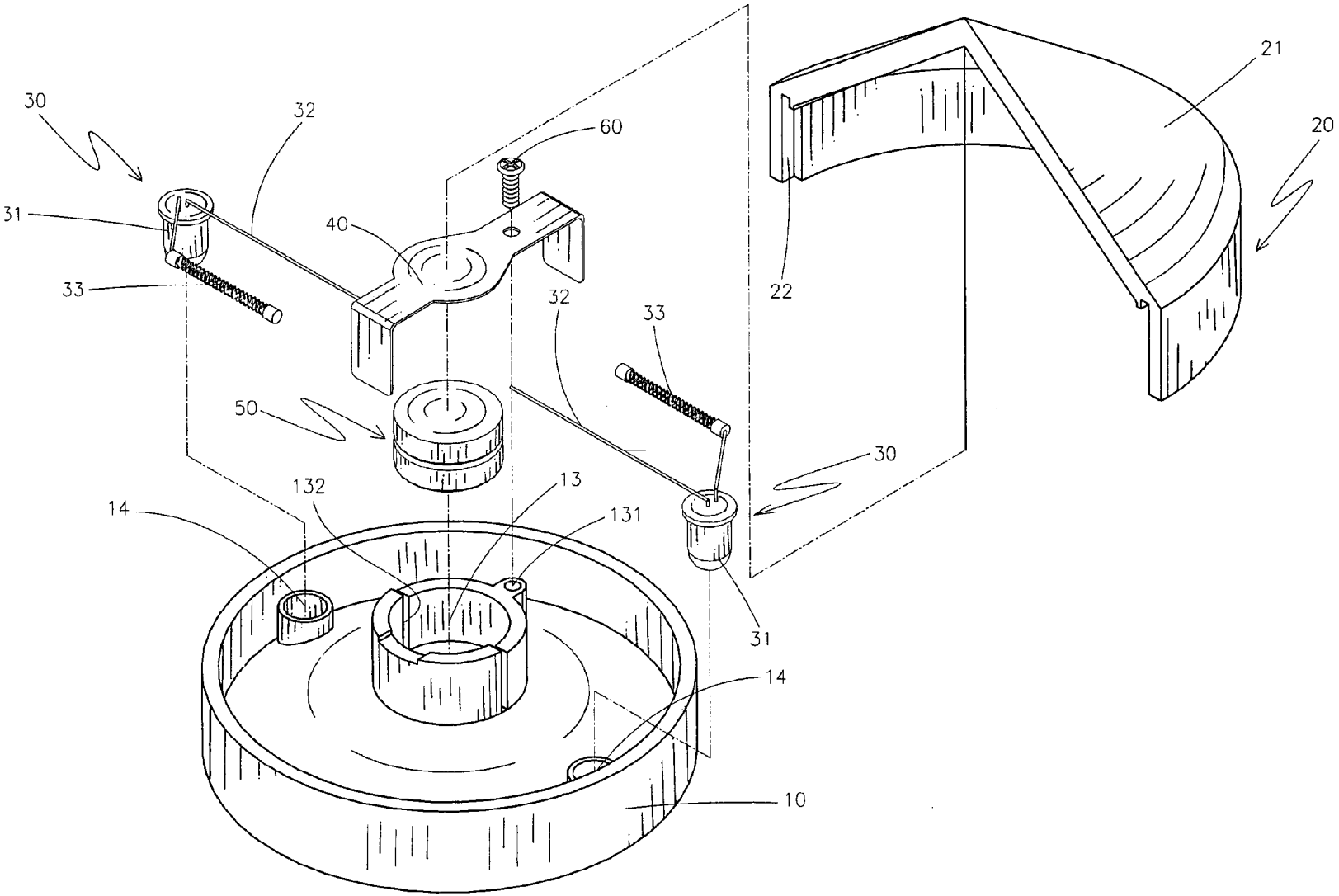
FIG. 6 is an exploded perspective view of a third embodiment of the top in accordance with the present invention.

With reference to FIG. 6 that shows a third embodiment of the top of the present invention, the cover (10) has two through holes (14) defined therein and diametrically corresponding to each other, and two slots (132) defined in the skirt (100). The two slots (132) diametrically correspond to each other. Each through hole (14) receives a lighting element (31) for promoting the lighting effect of the top of the present invention. Each first electrode (32) extends through a corresponding one of the two slots (132) in the skirt (100).

Figure 7:
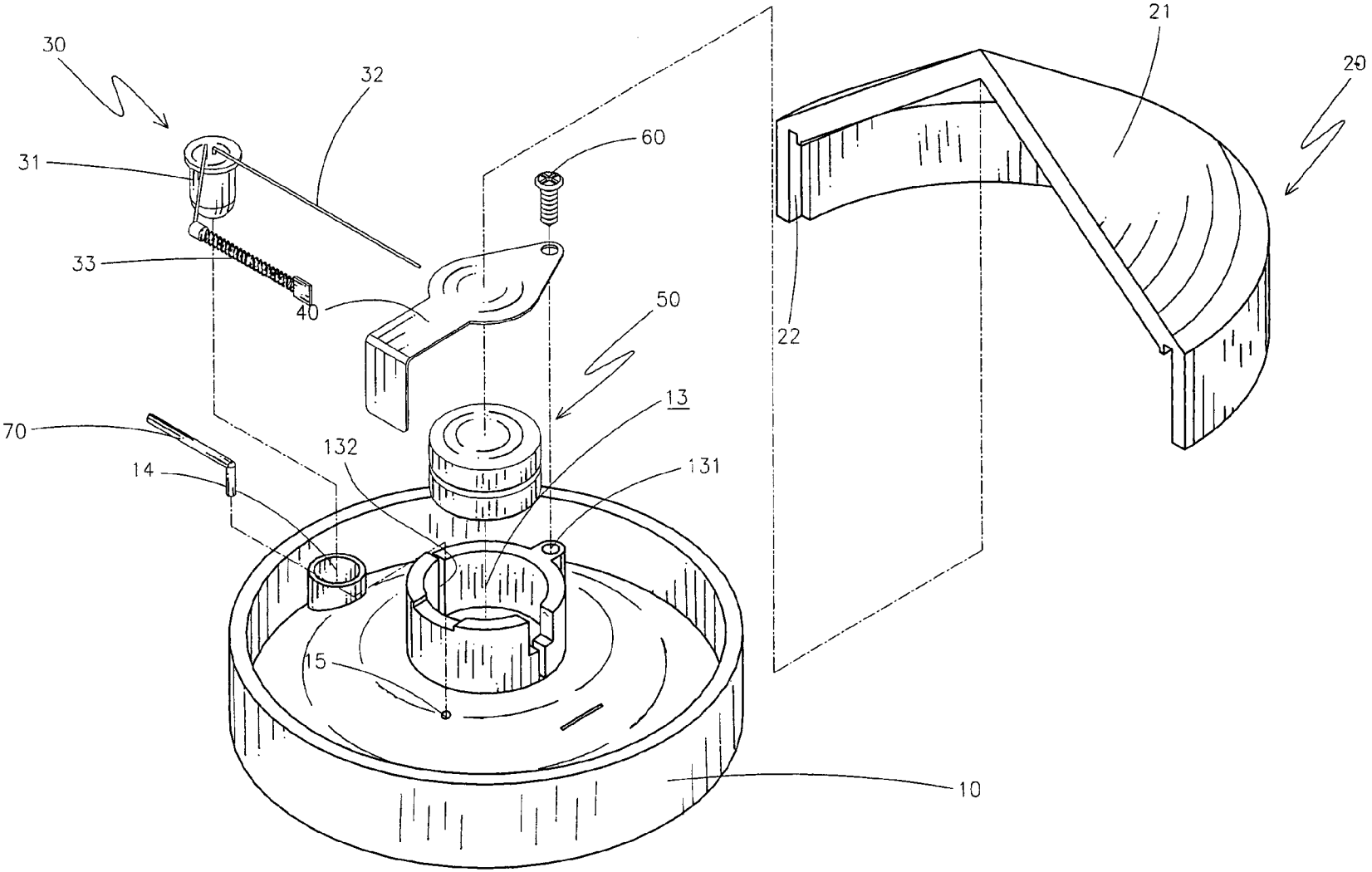
FIG. 7 is an exploded perspective view of a fourth embodiment of the top in accordance with the present invention.

With reference to FIG. 7 that shows a fourth embodiment of the top of the present invention, the cover (10) has a bore (15) defined in a bottom thereof. An L-shaped swing arm (70) is partially and pivotally received in the bore (15) and corresponds to the second electrode (33) of the lighting element (31) such that the L-shaped swing arm (70) is swung to push the second electrode (33) of the lighting element (31) to contact with the L-shaped electrode plate (40) due to a centrifugal force from the rotating top.

Although the invention has been explained in relation to its preferred embodiment, it is to be understood that many other possible modifications and variations can be made without departing from the spirit and scope of the invention as hereinafter claimed.

What is claimed is:

1. A top with a lighting device, comprising:

a hollow body and a cover detachably inserted into a top of the hollow body, the cover having a grip upward and centrally extending from a top of the cover and a buckle laterally extending from the cover for engaging the cover to the hollow body, at least one through defined in the cover, a skirt centrally and downward extending from a bottom of the cover to define a cavity for receiving a battery, a threaded hole longitudinally defined in the skirt and at least one slot defined in the skirt, an L-shaped electrode plate mounted to the skirt by a bolt that extends through the L-shaped electrode plate and is screwed into the threaded hole to hold the L-shaped electrode plate in place, the L-shaped electrode plate electrically connected to a first electrode of the battery; and the lighting device mounted in the hollow body, the lighting device including at least one lighting element received in the at least one through hole in the cover, the at least one lighting element having a first electrode extending through the at least one slot in the skirt and electrically connected to a second electrode of the battery, and a second electrode located between the skirt and the L-shaped electrode plate.

2. The top as claimed in claim 1, wherein the second electrode of the lighting element is a spring.

3. The top as claimed in claim 1, wherein the second electrode of the lighting element is a plate.

4. The top as claimed in claim 1, wherein the cover has two through holes defined therein and diametrically corresponding to each other, two slots defined in the skirt and diametrically corresponding to each other, each through hole receiving a lighting element and the second electrode of each of the two lighting element extending through a corresponding one of the two slots in the skirt and electrically connected to a second electrode of the battery.

5. The top as claimed in claim 1, wherein the cover further comprises a bore defined in a bottom thereof and an L-shaped swing arm partially and pivotally received in the bore, the L-shaped swing arm corresponding to the second electrode of the lighting element such that the L-shaped swing arm is swung to push the second electrode of the lighting element to contact with the L-shaped electrode plate due to a centrifugal force from the rotating top.

* * * * *